US008777558B2

(12) United States Patent
Brunet et al.

(10) Patent No.: US 8,777,558 B2
(45) Date of Patent: Jul. 15, 2014

(54) CASING FOR A MOVING-BLADE WHEEL OF TURBOMACHINE

(75) Inventors: Antoine Robert Alain Brunet, Moissy Cramayel (FR); Olivier Stephane Domercq, Brie Comte Robert (FR); Laurent Jablonski, Melun (FR); Vincent Paul Gabriel Perrot, Maisons Alfort (FR)

(73) Assignee: SNECMA, Paris (FR)

( * ) Notice: Subject to any disclaimer, the term of this patent is extended or adjusted under 35 U.S.C. 154(b) by 774 days.

(21) Appl. No.: 12/935,132

(22) PCT Filed: Mar. 25, 2009

(86) PCT No.: PCT/FR2009/050516

§ 371 (c)(1), (2), (4) Date: Dec. 13, 2010

(87) PCT Pub. No.: WO2009/125135

PCT Pub. Date: Oct. 15, 2009

(65) Prior Publication Data

US 2011/0085896 A1 Apr. 14, 2011

(30) Foreign Application Priority Data

Mar. 28, 2008 (FR) ..... 08 52012

(51) Int. Cl.

| | |
|---|---|
| ***F03B 11/02*** | (2006.01) |
| ***F04D 29/42*** | (2006.01) |
| ***F01D 25/24*** | (2006.01) |
| ***F04D 29/52*** | (2006.01) |
| ***F04D 29/16*** | (2006.01) |

(52) U.S. Cl.

CPC ..... *F04D 29/526* (2013.01); *F04D 29/164* (2013.01)

USPC ..... 415/58.6; 415/58.7; 415/173.1

(58) Field of Classification Search

USPC ..... 415/58.1, 58.5–58.7, 170.1, 173.1, 119, 415/914

See application file for complete search history.

(56) References Cited

U.S. PATENT DOCUMENTS

| | | | | |
|---|---|---|---|---|
| 4,466,772 | A * | 8/1984 | Okapuu et al. | 415/173.5 |
| 2007/0147989 | A1* | 6/2007 | Collins | 415/173.1 |

FOREIGN PATENT DOCUMENTS

| | | |
|---|---|---|
| DE | 10 2007 056 953 | 5/2009 |
| DE | 10 2008 010 283 | 8/2009 |
| EP | 1 801 361 | 6/2007 |
| JP | 60-256597 | 12/1985 |
| JP | 3 160198 | 7/1991 |
| JP | 9-88893 | 3/1997 |
| SU | 926 365 | 5/1982 |

OTHER PUBLICATIONS

International Search Report issued Oct. 22, 2009 in PCT/FR09/50516 filed Mar. 25,2009.

Japanese Office Action in corresponding Application No. JP2011/501279 issued Jul. 2, 2013 (w/ English Translation).

Chinese Office Action in corresponding Application No. CN2009/80111087.7 issued Jun. 19, 2013 (w/ English Translation).

* cited by examiner

*Primary Examiner* — Edward Look
*Assistant Examiner* — Christopher J Hargitt
(74) *Attorney, Agent, or Firm* — Oblon, Spivak, McClelland, Maier & Neustadt, L.L.P.

(57) ABSTRACT

A casing for a turbomachine rotor wheel includes a plurality of circumferential grooves, each of substantially constant section, with the section areas of the circumferential grooves decreasing from upstream to downstream on going from the first groove to the last groove. By treating the casing in this way, the efficiency of the rotor wheel is optimized and its surge margin is improved.

16 Claims, 1 Drawing Sheet

CASING FOR A MOVING-BLADE WHEEL OF TURBOMACHINE

BACKGROUND OF THE INVENTION

1. Field of the Invention

The invention relates to the field of turbomachine rotor wheels, and in particular compressor wheels. In turbomachines, rotor wheels associated with stator wheels form compressor stages having the function of compressing the fluid passing therethrough. The design and optimization of a cascade of rotor wheels (i.e. a sequence of one or more rotor wheels), e.g. for a compressor, requires two objectives to be taken into account.

2. Description of the Related Art

The first objective is to have good compression efficiency. Compression efficiency may be defined as the ratio of the energy that would ideally be imparted to the fluid by isentropic compression from upstream to downstream of the cascade of rotor wheels divided by the energy actually imparted to the fluid. (In the present document, upstream and downstream are defined relative to the normal flow direction of the fluid through the cascade of rotor wheels.)

The second objective is to guarantee sufficient "surge margin". Surge is a phenomenon of fluid instability that occurs within a compressor, giving rise to low frequency oscillations in the flow, and occurring when the flow rate, supply, pressure, and temperature conditions depart from the normal operating range of the turbomachine. Since this instability phenomenon usually develops a large amount of energy, it subjects the turbomachine to high levels of stress (statically and dynamically). It can thus readily be understood that a constant objective during the development of a cascade of rotor wheels is to extend its normal operating range as much as possible so that the compressor or the turbomachine of which it forms a part has a "surge margin" that is sufficient and that enables surge phenomena to be avoided.

In known manner, specific arrangements are made for rotor wheels in order to optimize the second objective, specifically optimizing surge margin.

In a rotor wheel or bladed rotor wheel, the radial clearance in operation between the stationary casing and the moving blades gives rise to a secondary flow referred to as the clearance flow. This flow gives rise to significant losses in the efficiency of rotor wheels and, in a majority of cases, may give rise to the loss of stability in the compressor (the surge phenomenon). Thus, in order to satisfy the second above-mentioned objective and maximize the surge margin of the rotor wheel cascade, it is known to treat the inside wall of the casing where it faces the ends of the rotor wheel blades.

By way of example, casing treatment may consist in forming a set of grooves in the inside wall of the casing. By means of these grooves, the surge margin of the rotor wheel is improved. Patent GB 2 408 546 thus provides an example of turbomachine casing treatment. Nevertheless, in the casing treatment disclosed therein, the arrangement of the grooves is very particular: the grooves are not circumferential, but are slots that are spaced apart circumferentially from one another with an angle of inclination relative to the radial direction that varies. As a result, the casing is relatively complex to fabricate and is therefore expensive, but without that ensuring that the casing can simultaneously increase surge margin and optimize compression efficiency.

In practice, most casing treatments are intended solely for optimizing the surge margin of the compressor without worrying about the often negative impact that has on compression efficiency.

BRIEF SUMMARY OF THE INVENTION

The object of the present invention is to define a casing for a rotor wheel of a turbomachine, said casing having an inside wall that is substantially cylindrical about an axis of the casing, the cylindrical wall presenting a plurality of circumferential grooves each of section that is substantially constant in an axial section plane, which casing is optimized to simultaneously improve the surge margin and to optimize the efficiency of the associated turbomachine rotor wheel.

This object is achieved by the fact that in the casing, the section areas (S1, S2, S3) of the circumferential grooves (11, 12, 13) decreases from upstream to downstream going from the first groove (11) to the last groove (13).

The term "upstream end" is used above to designate an end of the casing that is designed to be located on the upstream side of the casing.

The term "circumferential groove" is used to mean grooves that are disposed substantially in a plane perpendicular to the axis of the rotor wheel. They are thus typically circular grooves lying in a plane perpendicular to the axis of the rotor wheel. These grooves are not necessarily continuous, and they do not necessarily occupy a complete circumference around the casing. Nevertheless, in order to ensure that they have sufficient effectiveness, particularly in improving the surge margin of the cascade of rotor wheels, it is necessary for them to occupy a large fraction of the circumference of the casing.

The fact that each circumferential groove is of section that is substantially constant in an axial section plane means that regardless of which axial section plane is selected for evaluating the section, the section of the groove is substantially the same.

The advantage of the invention results from the following two observations: firstly, it is essentially the first groove on the upstream sides of the rotor wheel that contributes to improving the surge margin, the other grooves having decreasing contributions to this improvement as a function of their distance from the first groove; and secondly each of the grooves has an impact that is generally negative on the compression efficiency of the cascade of rotor wheels.

Thus, in order to optimize simultaneously the efficiency of the rotor wheel and improve the surge margin, the invention gives precedence to the area of the section of the first groove(s) relative to the following grooves (i.e. a group of grooves situated upstream from the other groove(s) that are situated further downstream).

In general, it is the first groove at the upstream end that has a section area greater than the section area of any of the other grooves. Nevertheless, the invention also covers an embodiment in which the casing presents, from upstream to downstream, two grooves of sections having the same area, followed by two grooves of sections having smaller area, and so on. In the invention, any variation in groove section area may be envisaged, providing the areas of the sections of said circumferential grooves decrease going from upstream to downstream from the first groove to the last groove. This decrease may be regular, as for example when the section area of the grooves decreases linearly from upstream to downstream. In another embodiment, the decrease in the section area of the grooves may equally well take place in steps.

It should be observed that the grooves under consideration are grooves that are located substantially in register with the blades of the rotor wheel, independently of the shape of the casing upstream and downstream from the rotor wheel.

In an embodiment, each of the grooves extends substantially in a plane that is perpendicular to the axis of the casing.

In an embodiment, the depth of the first of said circumferential grooves is greater than the depths of the following grooves situated further downstream.

In an embodiment, the depths of said circumferential grooves decrease from upstream to downstream.

Advantageously, the decrease in the depth of said circumferential grooves is linear.

In an embodiment, the width of the first of said circumferential grooves is greater than the widths of the following grooves situated further downstream.

In an embodiment, the widths of said circumferential grooves decrease from upstream to downstream along the axis of the casing.

The various above-mentioned embodiments make it possible in accordance with the invention simultaneously to optimize the efficiency of the rotor wheel and to improve its surge margin by acting on various parameters that may thus be optimized as a function of other constraints that need to be taken into account when designing the cascade of rotor wheels.

In an embodiment, the casing presents substantially cylindrical junction surfaces between consecutive grooves, and the diameter of the junction surfaces is substantially equal to the mean value of the inside diameters of the casing measured respectively upstream and downstream from the grooves.

By means of this configuration, the flow in the clearance between the ends of the blades and the casing takes place (ignoring the grooves) in a space of diameter that varies regularly, thereby reducing undesirable turbulence.

A second object of the invention is to define a high efficiency turbomachine with a large surge margin.

This object is achieved by the fact that the turbomachine has a rotor wheel and a casing as defined above. Thus, the performance of the turbomachine is optimized and it benefits from optimized efficiency and improved surge margin.

BRIEF DESCRIPTION OF THE SEVERAL VIEWS OF THE DRAWINGS

The invention can be well understood and its advantages appear better on reading the following detailed description of an embodiment given by way of non-limiting example. The description refers to the accompanying drawing, in which.

DETAILED DESCRIPTION OF THE INVENTION

Figure 1:
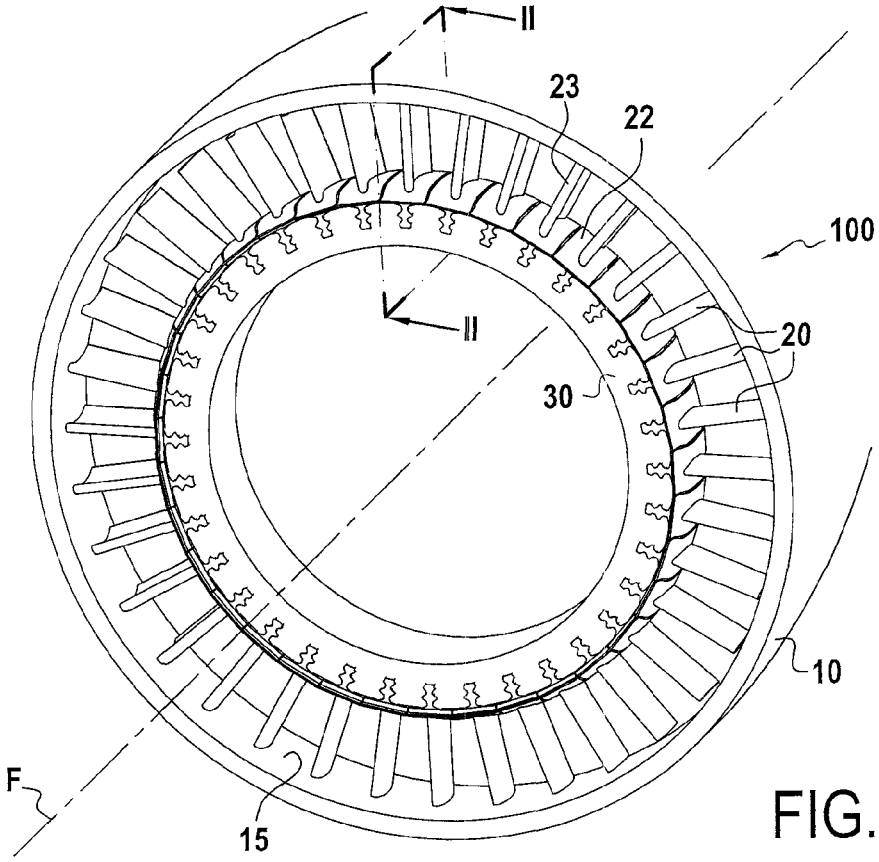
FIG. 1 is a perspective view of a rotor wheel for a turbomachine including a casing of the invention.

With reference to FIG. 1, there follows a description of a casing of the invention for rotor wheels.

FIG. 1 shows a rotor wheel 100. This rotor wheel 100 mainly comprises a rotor disk 30 and blades 20 that are movable in rotation about an axis F inside a stator that is constituted by a stationary casing 10. In the rotor wheel, the disk 30 is a :ring-shaped part having the function of holding and moving the blades 20 in rotation. The blades are generally fastened to the rotor disks via their roots via fasteners of hammer-head or Christmas-tree configuration. Each blade is thus constituted by a root, a platform 22 that constitutes the inside portion of the flow-passing section, and an airfoil 23. The blades may alternatively be made out of the same block of material as the rotor disk, in which the disk is referred to as a one-piece bladed disk. The flow passes substantially along the axis F of the rotor wheel through inter-blade passages located between the airfoils 23 of the various blades. In the radial direction, the flow passes between the platforms 22 of the blades and the inside of the casing 10 for the rotor wheel. Each blade has an airfoil 23 extending in a substantially radial direction. The blade root is located towards the center of the rotor wheel, with the airfoil 23 extending outwards. When the rotor wheel is in rotation, the end of the airfoil 23 is thus caused to travel at high speed in the vicinity of the stationary casing 10. For the rotor wheel to operate efficiently, it is important to have good control over the clearance (B1, B2) between the ends of the blades and the inside wall 15 of the casing. It is essential for this clearance to be small. The clearance is described in detail with reference to FIG. 2.

Figure 2:
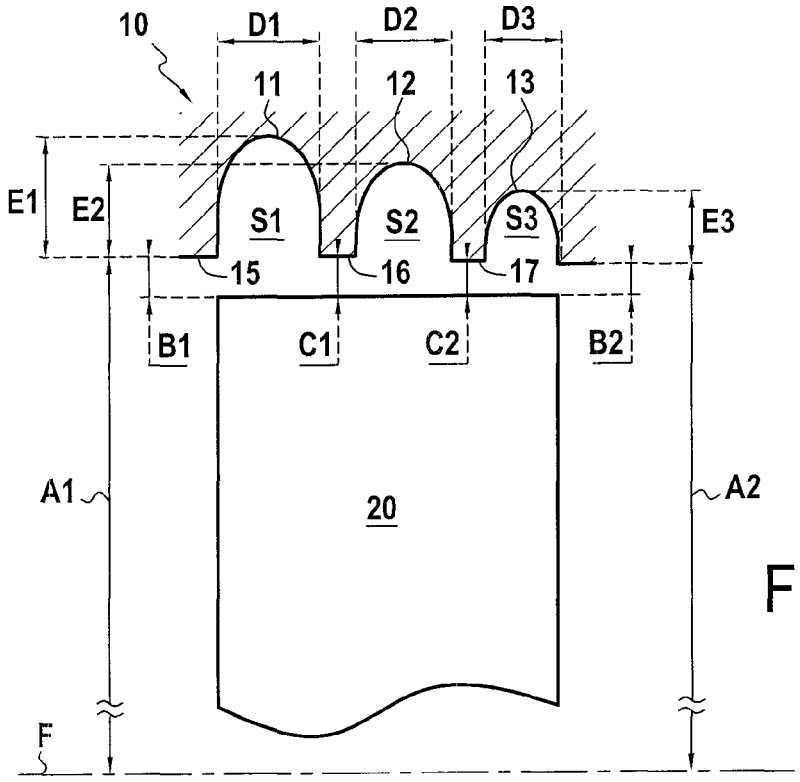
FIG. 2 is an axial section of the rotor wheel shown in FIG. 1, showing the treatment of the casing of the invention.

FIG. 2 is a section showing the end of a blade 20 facing the corresponding section of the casing 10. To allow the blade 20 to rotate relative to the casing 10, clearance is left between the blade and the casing. This clearance may thus have a value B1 on the upstream side of the blade and a value B2 on the downstream side in the example shown. The section shows the sections of three grooves 11, 12, 13 that extend radially or substantially radially. These three grooves are located in register with the tip of the blade 20; they may extend a little upstream or downstream from said tip. The grooves 11, 12, and 13 constitute treatment applied to the casing for the purpose of improving the surge margin in the turbomachine of which the rotor wheel forms a part, while enabling the rotor wheel to have good efficiency. To achieve this object, the arrangement of the grooves in accordance with the invention shows that the grooves 11, 12, and 13 present sections of respective areas S1, S2, and S3 that decrease going from upstream to downstream. The grooves 11, 12, and 13 are radial circular grooves, each forming a complete turn around the casing in a plane perpendicular to its axis F. The areas S1, S2, and S3 decrease linearly. This decrease in the areas of the grooves from upstream to downstream and the dominance of the first groove relative to the following grooves are obtained both by varying the widths cf the grooves and also by varying their depths.

Thus, the first groove has the greatest width D1 measured along the axis F of the casing, and also the greatest depth E1 measured radially. Similarly, the depths of the grooves decrease linearly from upstream to downstream amongst the three grooves 11, 12, and 13, which thus present respective depths E1, E2, and E3 that decrease linearly; similarly, the respective widths D1, D2, and D3 measured along the axis F of the casing of the three grooves also decrease linearly from upstream to downstream.

To minimize the turbulence that occurs between the tips of the blades 20 and the wall of the casing 10, the clearances between the end of the blade and the inside wall 15 of the casing 10 vary continuously from upstream to downstream along the rotor wheel.

At the tip of the blade, these clearances, from upstream to downstream comprise: a first clearance B1 relative to the inside wall 15 of the casing; a clearance C1 relative to the junction surface 16 between the grooves 11 and 12; a clearance C2 relative to the junction surface 17 between the grooves 12 and 13; and finally a clearance B2 relative to the inside wall 15 of the casing (with the notion of clearance not being defined in register with the grooves 11, 12, and 13).

In order to allow the flow to pass in regular manner generating little turbulence through the rotor wheel in the vicinity of the radially outer ends of the blades, the clearances B1, C1, C2, and B2 are of similar values. Correspondingly, it may also be observed that the junction surfaces 16 and 17 between the grooves are substantially cylindrical and of diameters that are substantially equal to a mean diameter between the upstream diameter A1 measured upstream from the blade 20 and the downstream diameter A2 measured downstream thereof.

The grooves 11, 12, and 13 shown in FIG. 2 extend radially, i.e. each of them lies substantially in a plane perpendicular to the axis of the casing. In a variant, the grooves could equally well be oblique, i.e. the grooves need not be formed perpendicularly to the inside wall 15 of the casing, but may extend obliquely, either upstream or downstream relative to the rotor wheel.

Furthermore, in practice, the depth E1 of the grooves lies typically in the range half of the mean clearance up to thirty times the mean clearance, where the mean clearance is measured between the tip of the blade 20 and the inside wall 15 of the casing 10. Furthermore, the depth, the area, and/or the width of a groove is typically divided by two to five on going from the first groove at the upstream end of the casing treatment to the last groove of the casing treatment.

Finally, the embodiment shown in FIG. 2 has three grooves of sections that present areas that decrease regularly. Numerous other embodiments could be used. In particular, instead of having sections of areas that decrease regularly, it is possible to have a first group of grooves upstream all with the same section area that is greater than the section area common to other grooves that are situated further downstream.

The invention claimed is:

1. A casing for a rotor wheel of a turbomachine, the casing comprising:

an inside wall that is substantially cylindrical about an axis of the casing, the cylindrical inside wall presenting a plurality of circumferential grooves each of section that is constant in an axial section plane, wherein section areas of the circumferential grooves decrease from upstream to downstream going from a first of the grooves to a last of the grooves, wherein said plurality of circumferential grooves includes all of the grooves provided substantially in register with blades of the rotor wheel, and wherein a depth of the first of said circumferential grooves, which is a most upstream groove, is strictly greater than depths of the following grooves situated downstream.

2. A casing according to claim 1, wherein the decrease in section area of the grooves from upstream to downstream is linear.

3. A casing according to claim 1, wherein depths of the circumferential grooves decrease from upstream to downstream.

4. A casing according to claim 3, wherein the decrease in the depth of the circumferential grooves is linear.

5. A turbomachine including a rotor wheel and a casing according to claim 3.

6. A casing according to claim 1, wherein a width of the first of the circumferential grooves is greater than widths of following grooves situated further downstream.

7. A turbomachine including a rotor wheel and a casing according to claim 6.

8. A casing according to claim 1, wherein widths of the circumferential grooves decrease from upstream to downstream.

9. A turbomachine including a rotor wheel and a casing according to claim 8.

10. A casing according to claim 1, presenting substantially cylindrical junction surfaces between consecutive grooves, wherein a diameter of the junction surfaces is substantially equal to a mean value of inside diameters of the casing measured respectively upstream and downstream from the grooves.

11. A turbomachine including a rotor wheel and a casing according to claim 10.

12. A casing according to claim 1, wherein each of the grooves extends substantially in a plane that is perpendicular to an axis of the casing.

13. A turbomachine including a rotor wheel and a casing according to claim 12.

14. A turbomachine including a rotor wheel and a casing according to claim 1.

15. A turbomachine including a rotor wheel and a casing according to claim 4.

16. A casing for a rotor wheel of a turbomachine according to claim 1, wherein a depth of the first of said circumferential grooves is between half of a mean clearance between a tip of a blade of the rotor wheel and the inside wall of the casing to thirty times the mean clearance.

* * * * *